United States Patent [19]

Harmsen et al.

[11] 4,275,258

[45] Jun. 23, 1981

[54] WATER-COOLED BOX DESIGNED AS WALL ELEMENT FOR A MELTING FURNACE

[75] Inventors: Lothar Harmsen, Lingen; Klaus Bick, Paderborn; Wilhelm Lachenmayer, Detmold; Friedhelm Vennmann; Jürgen Zieschang, both of Lingen, all of Fed. Rep. of Germany

[73] Assignee: Benteler-Werke AG, Paderborn, Fed. Rep. of Germany

[21] Appl. No.: 44,334

[22] Filed: May 31, 1979

[30] Foreign Application Priority Data

Jun. 10, 1978 [DE] Fed. Rep. of Germany ..... 2825536

[51] Int. Cl.[3] ..... F27D 1/12

[52] U.S. Cl. ..... 13/32

[58] Field of Search ..... 13/32, 35

[56] References Cited

U.S. PATENT DOCUMENTS

| | | | |
|---|---|---|---|
| 3,940,552 | 2/1976 | Mizuno | 13/32 X |
| 4,021,603 | 5/1977 | Nanjyo et al. | 13/35 |
| 4,097,679 | 6/1978 | Fukumoto et al. | 13/32 |
| 4,122,295 | 10/1978 | Nanjyo et al. | 13/32 |

*Primary Examiner*—Roy N. Envall, Jr.

*Attorney, Agent, or Firm*—Michael J. Striker

[57] ABSTRACT

A box-shaped shallow, water-cooled element of steel plate for the construction of a wall portion of a melting furnace above the melt in the furnace, has a front wall adapted to face the interior of said furnace. This front wall is provided with a plurality of recesses of equal cross-section equally spaced from each other in the form of elongated grooves or bores to facilitate adhesion of a layer of refractory material to be applied thereto, wherein the recesses are machined in the surface of the front wall adapted to be directed to the interior of the furnace in such a manner that the area of recesses at this surface is smaller than the area of the remaining non-machined surface to thus enhance heat conduction from the interior of the furnace to the cooling water passing through the wall element and to prevent damage of the front wall when the protective layer is missing completely or in part.

13 Claims, 12 Drawing Figures

WATER-COOLED BOX DESIGNED AS WALL ELEMENT FOR A MELTING FURNACE

Figure 1:
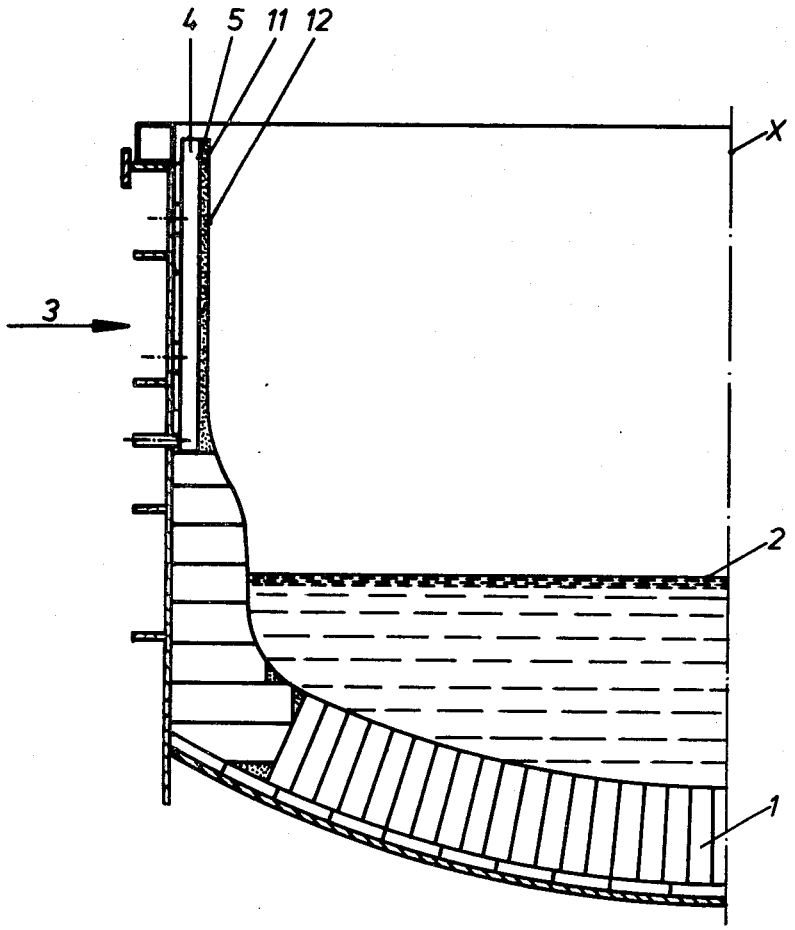

The invention concerns a water-cooled box made of steel plate, enclosed on all sides, designed as wall element, partly replacing the usually employed refractory lining in the wall zone above the bath level of a melting furnace, in particular an arc furnace, with a front wall suitable for the adhesion of, respectively, refractory mortar or furnace slag, bent according to the curvature of the furnace, with a back wall running parallel to the front wall as well as two narrower side walls lying opposite to each other, and one each, top and bottom wall, parallel to each other, the box allowing cooling with water through an inlet and an outlet opening and with at least one guide vane for the cooling water in its interior. Wherein the steel wall of the box facing the furnace interior is provided on its outer surface with adhesive devices for the better adhesion of the initially applied layer of refractory mortar, as well as of the fireproof layer of slag formed upon it by spattered slag during the furnace operation.

The box of this type shall protect the steel wall of the furnace vessel from the radiant heat of the melt and of the arc, since otherwise the former would be destroyed due to the high temperatures. Usually, refractory materials are used for the protection of the vessel walls. These refractory materials are subject to thermal and mechanical wear and must be repaired, or replaced entirely by new material, at regular intervals. Every repair or relining represents an interruption of production. The boxes should have a longer life than the refractory materials in order to increase the available time of the melting furnace, so that a higher productive capacity can be reached. The box furthermore serves to dissipate, through the cooling water, heat given off in the surroundings of the furnace, whereby the temperature surrounding the furnace will drop, which means an improvement in the working conditions of the operating personnel.

Using boxes of the type described, the conventional refractory lining of that zone of the furnace wall which cannot be reached by the melt may be fully or partially saved. By this, the operating costs of the furnace will be considerably reduced. In order to increase the life of the boxes, the front wall of the box must offer good adhesion to the refractory mortar which is applied manually or mechanically, and to the slag spattered by the arc against the box. The adhering refractory mortar and the spattered slag have, apart from protecting the box from the radiant heat, also heat-insulating properties so that the quantities of heat to be dissipated from the melting furnace through the cooling water in the box can be held small.

The box of the type described at the beginning, welded from steel plate and to be filled with a cooling medium, cooling water in particular, is known from the German Letter of Disclosure DE-AS 26 59 827. Herein, the adhesive devices are designed as profiled projections in the form of hollow shapes set upon the plate wall of the box facing the furnace interior. The projections have in particular the form of, respectively, U or V shapes, open at the top, or they are in the shape of a pipe sector with the slot pointing upward. The known box of this type cannot satisfy entirely, since the hollow structural irons set at the outside are exposed to the danger of local melting. The cause of the melting lies in the unfavorable ratio between the profile cross sections through which the heat is conducted onto the cooling box wall, and the surface which absorbs heat from the furnace atmosphere or the radiation of the arc. By this reason, even profiles which are welded onto the box wall are in jeopardy, especially, for instance, as mechanical stress could cause local damage or destruction of, respectively, the refractory lining or the slag lining.

The invention is based upon the task of providing the box wall facing the furnace interior with adhesive devices whereby melting-off by the radiation from the arc and the melt is precluded. These devices must be shaped in such a way that adhesion of the refractory and slag layers is permanently ensured. The danger of their bursting or stripping should be precluded for at least a longer operating period. Should these layers, however, burst or be destroyed, the adhesive devices should offer immediate adhesion to the slag spattered by the arc onto the front wall of the box, so that upon the bursting of one layer, a new insulation from slag will have formed on the front wall of the box. These adhesive devices should ensure that during the entire melting sequence. The front wall of the box is covered with a refractory or slag layer of even thickness. The front wall of the box should also be so designed that it can also not be damaged or destroyed by the influence of heat, when the protective layer of refractory mortar or spattered slag is missing in part or in full. The invention is furthermore based upon the task of providing a suitable method for the manufacture of the box as per invention.

The task set as the basis of the invention is solved in respect of the design of the adhesive devices in such a way that a multitude of recesses worked into the solid material of the box is provided, distributed across the width and height of that plate wall of the box which is facing the furnace interior.

If the adhesive devices are designed as recesses worked into the solid material of the box, the layer of refractory mortar initially applied to the plate wall of the box facing the furnace interior, can be set thereon with an enduring and high degree of bonding. During furnace operation, the additional slag layer will develop good bonding. Both layers of fireproof material will be held securely in the zone of the recesses.

Those areas protruding from the worked-in recesses, will conduct the heat produced by the furnace to the cooling water, which will not lead to thermal wear, since the ratio of the heat-conducting cross section to the heat-absorbing surface is high, and the transfer of heat is not encumbered by welded joints.

With a preferred version of the invention, the recesses provided in the plate wall of the box are designed as longitudinal recesses in the shape of grooves. It may, however, also commend itself to design recesses as cylindrical recesses. In both cases, a strong bonding of the two fireproof layers with the plate wall of the box facing the furnace interior will be attained, especially if the recesses show rectangular transition zones to those sections of the plate wall that laterally abut the recesses. This sharp-edged design of the transition zones of the recesses is a further feature preferred as per invention.

In a further development, the wall thickness of the plate wall of the box facing the furnace interior is set between 20 mm and 40 mm and the depth of the recesses is about equal to half the wall thickness of the plate wall of the box facing the furnace interior. The wall thickness of 20 to 40 millimeters means, first of all, that the steel plate of the box is safe also against higher mechanical stresses during charging or furnace operation, for instance in case of uncontrollable thrusts or impacts by the changing baskets. As far as the recesses are shaped as cylindrical recesses, it is preferred for increasing the adhesive capability of the wall of the box facing the interior of the furnace, to distribute these recesses checkerboardlike, with equal lateral distances across the width and height of the steel wall.

If the recesses are shaped as longitudinal recesses in the form of grooves, it is recommended that these recesses run either in the direction of the circumference of the furnace or vertically to the circumference of the furnace. Longitudinal recesses running in the direction of the circumference of the furnace mean that spattered slag impinging during the furnace operation upon the steel wall of the box facing the furnace interior will be held in the zone of the recesses immediately upon impinging, without any larger quantity of slag running down along the steel wall.

According to a further feature of the invention, several grooves are provided, running next to each other at an indentical lateral distance, where the lateral distance is dimensioned with 20 to 40 millimeters, preferably about 30 millimeters. If several longitudinal recesses running next to each other at the aforementioned lateral distance are provided, it is recommended that the width of the longitudinal recesses in their zones of transition to the sections of the steel wall laterally abutting the recesses is dimensioned with 10 to 20 millimeters, preferably about 15 millimeters.

It is furthermore preferred to provide several recesses running next to each other at an identical lateral distance, where the ratio of width: a lateral distance is set at about 1:2. It has been shown that with this ratio of width to lateral distance, bridges of the slag layer will be formed between neighboring longitudinal recesses soon after the begin of the furnace operation. The ratio of width: lateral distance: depth of the recesses, is preferably set at about 1:2:1.

To increase the adhesion of the plate wall of the box facing the interior of the furnace, it is preferred that the longitudinal recesses, i.e. grooves running in the direction of the circumference of the furnace or at a right angle to it, will reach in essence across the entire width and height of the steel wall. The bonding between the two fireproof layers on the wall facing the furnace of the interior, is further increased if the longitudinal cylindrical recesses have, for instance, a swallowtail section, and a taper in the direction of the interior of the furnace.

It is of particular advantage of the adhesive devices as per invention, that the recesses in the plate wall of the box facing the interior of the furnace, can be made with simple means and at favorable cost.

To make the recesses in the plate wall of the box facing the interior of the furnace, it is recommended to proceed with the fabrication of the plate wall from a flat steel plate, shaping the longitudinal of cylindrical recesses into the flat steel plate by machining, especially milling, or cutting or drilling respectively, and then bending the steel plate according to the curvature of the furnace wall in one bending sequence, no metal being removed on bending.

Applying this method, the grooves running vertical to the direction of the circumference of the furnace will, directly during bending, be given a swallowtail section in such a manner, that the grooves will taper in the direction of the interior of the furnace. In the forming of the thick-walled plate sheet, the swallowtail shape in the zone of the grooves is particularly enhanced since in this zone the wall thickness is reduced to about one-half. This distortion of the groove section during bending, can further be increased by giving the stamping tool a rib-like projection in the direction of the grooves, wherein the ribs are made somewhat wider than the grooves before distortion begins. This favorable impressing effect can also be reached with cylindrical recesses, i.e. bores, if these are arranged in vertical rows. By the bending sequence, the bores arranged in a row will become out of round. They are slightly enlarged vertically and tapered horizontally toward the furnace interior.

Figure 2:
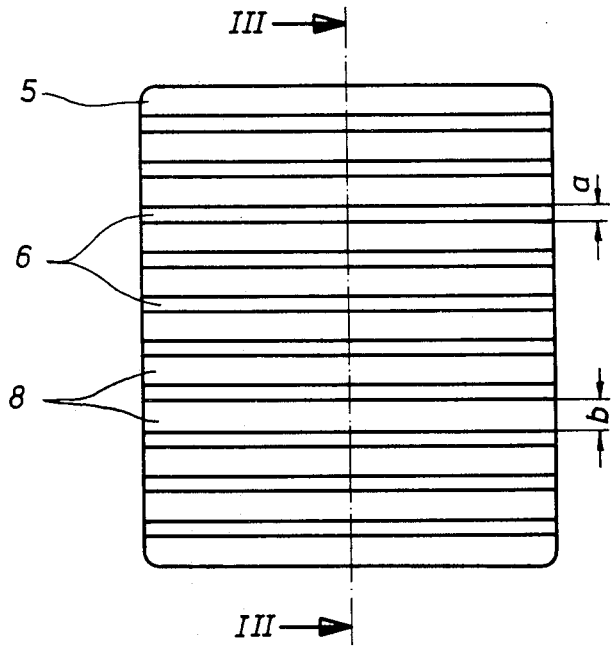
Figure 3:
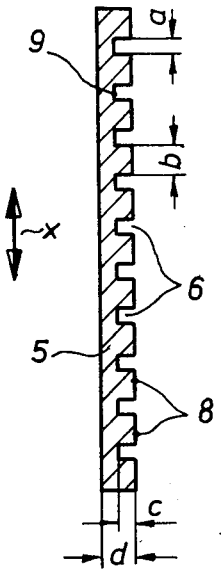
Figure 4:
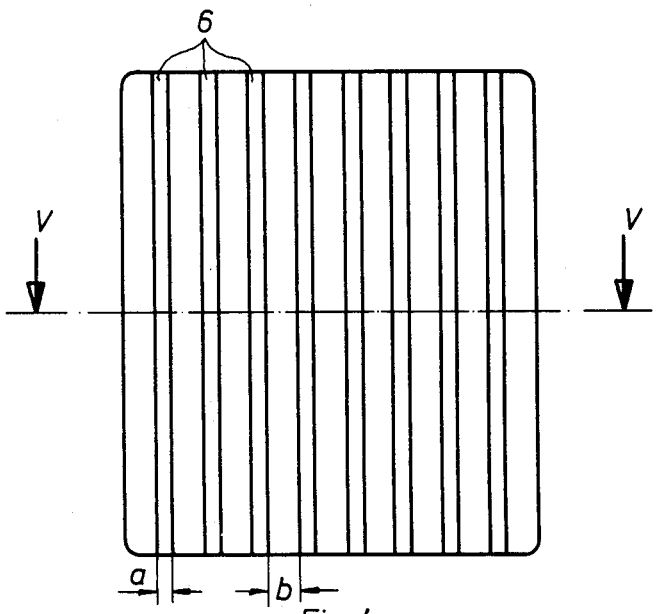
Figure 5:
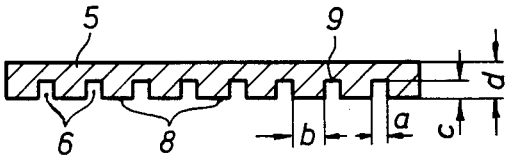
Figure 6:
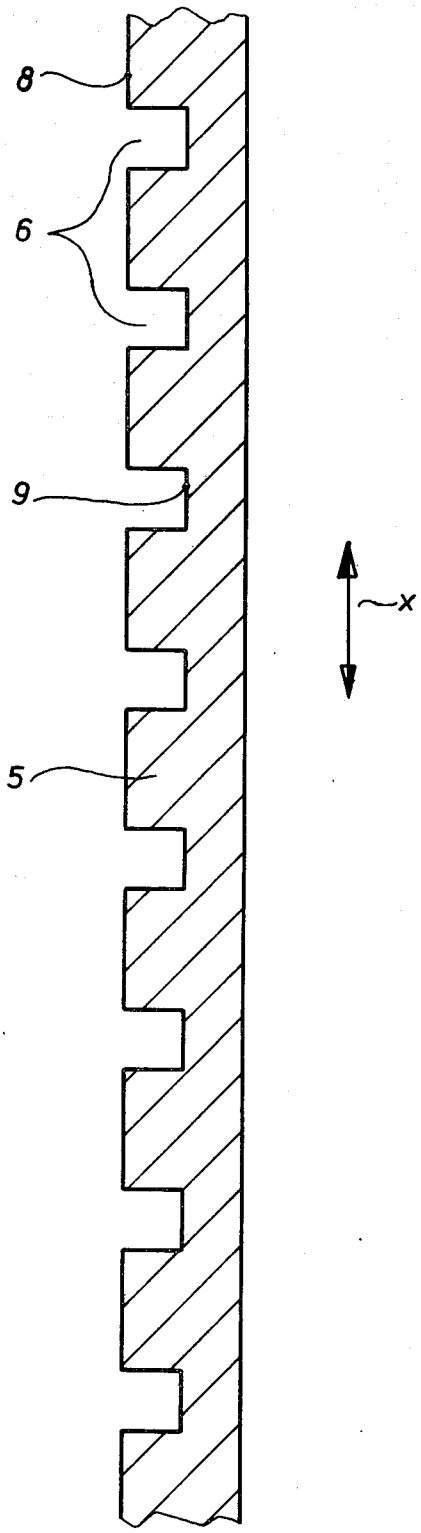
Figure 7:
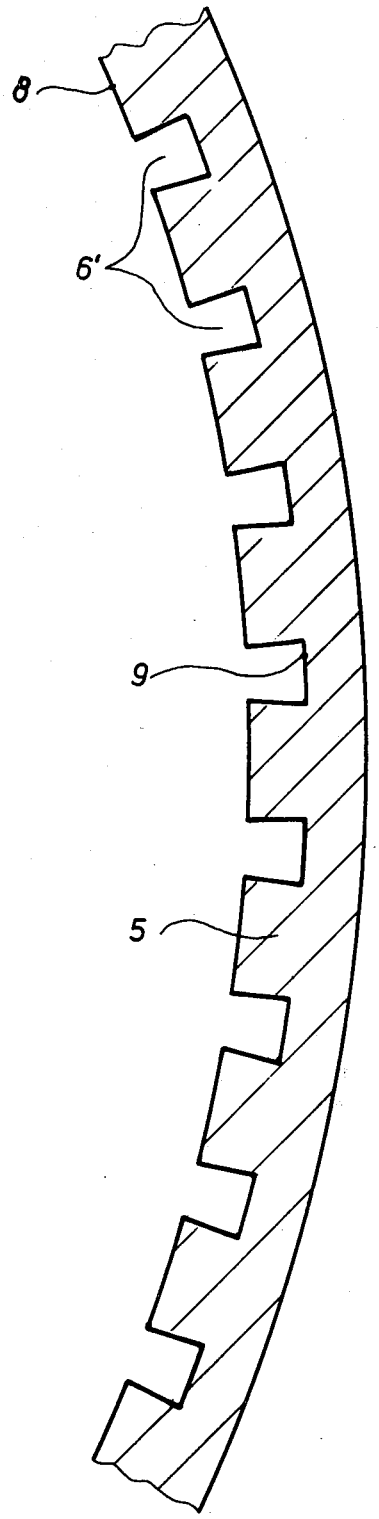
Figure 8:
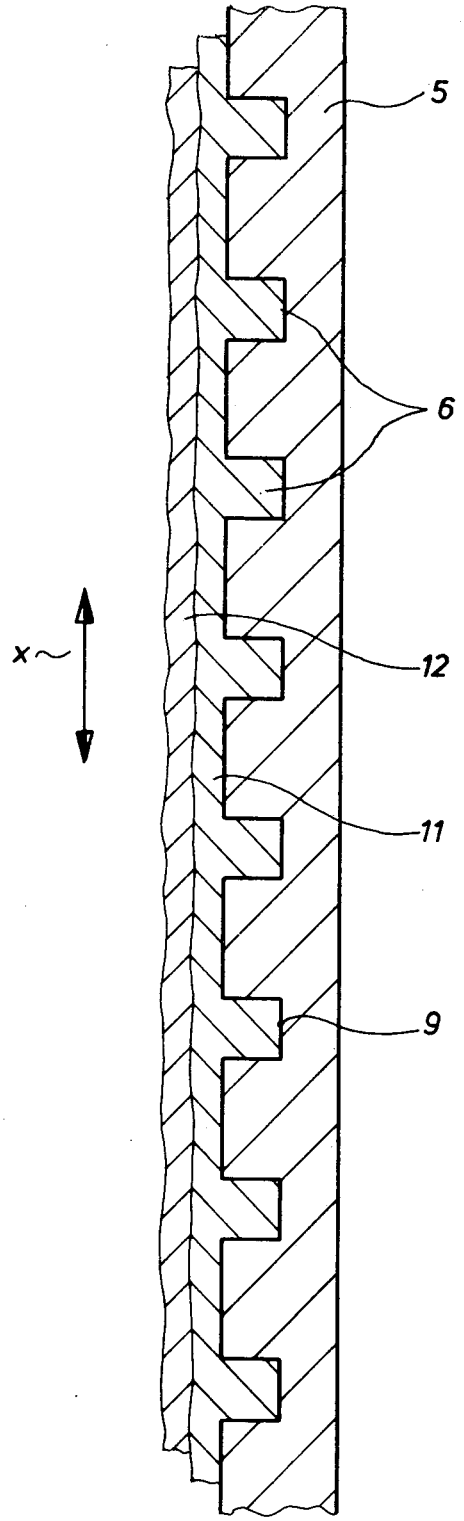
Figure 9:
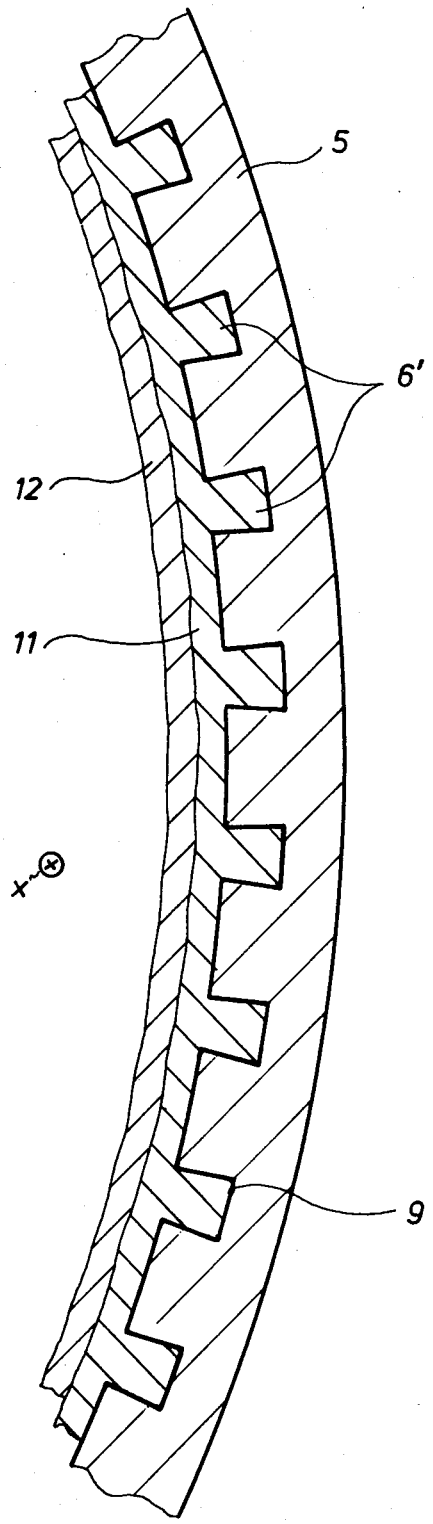
Figure 10:
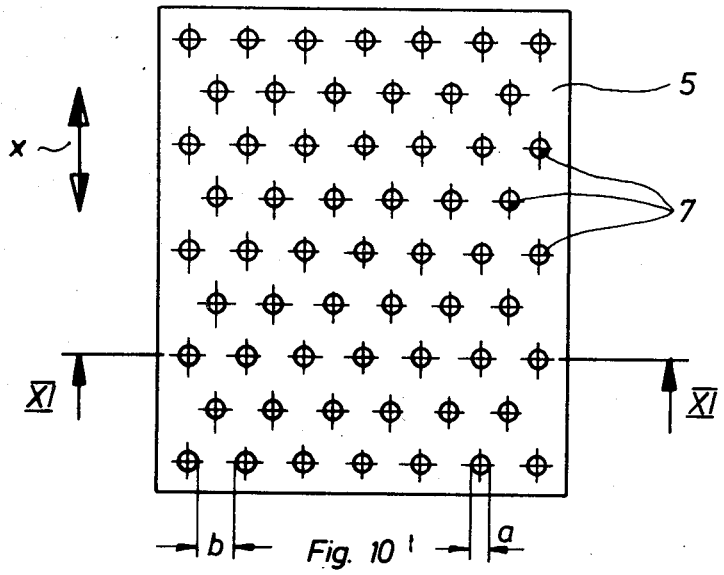
Figure 11:
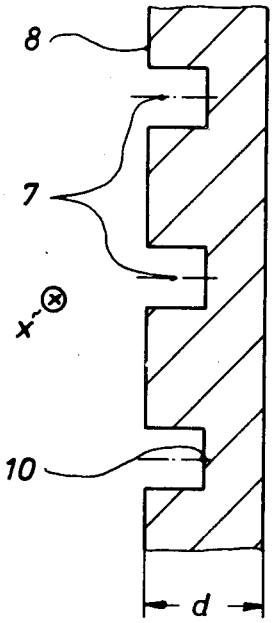
Figure 12:
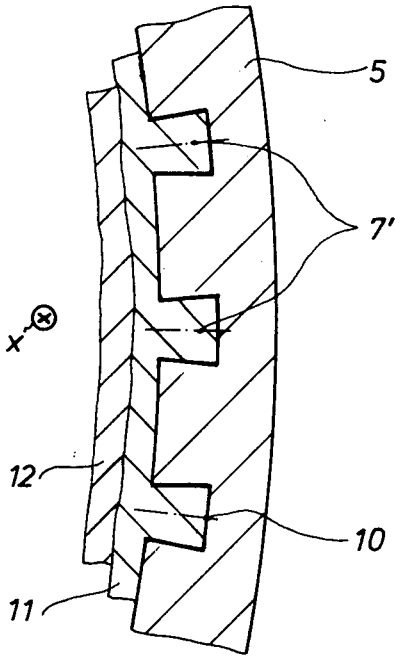

The theory as per invention is explained hereunder with the aid of a drawing showing a schematic of a vertical arc furnace with circular horizontal cross-section, equipped with the boxes as per invention shown in FIG. 1 the electrical arc furnace without cover and electrodes in an axial section, FIG. 2 the steel wall facing the furnace interior of a box as per a first version of the invention, front view, without refractory layers, FIG. 3 the plate wall of FIG. 2 in vertical section through line III—III of FIG. 12 without refractory layers;

FIG. 4 the plate wall facing the furnace interior of a 2nd version of a box as per invention, front view, without refractory layers;

FIG. 5 the plate wall of FIG. 4 in horizontal section along V—V of FIG. 4 without refractory layers;

FIG. 6 the plate wall of FIG. 2 in vertical section along line III—III of FIG. 2 without refractory layers, but in bent state;

FIG. 7 the plate wall of FIG. 4 in horizontal section along line V—V of FIG. 4 without refractory layers, but in bent state;

FIG. 8 the plate wall of FIG. 2 in vertical section along line III—III of FIG. 2, in bent state and also with refractory layers;

FIG. 9 the plate wall of FIG. 4 in horizontal section along line V—V of FIG. 4, in bent state and with refractory layers;

FIG. 10 The plate wall facing the furnace interior of a third version of a box as per invention, in front front view without refractory layers;

FIG. 11 The plate wall of FIG. 10 in horizontal section XI—XI without refractory layers;

FIG. 12 the steel wall of FIG. 10 and 11, in horizontal section along line XI—XI of FIG. 10, in bent state and with refractory layers.

FIG. 1 shows the arc furnace, without cover and electrodes, in axial section. The furnace crucible 1 fitted with brick lining ends in the upper section about 40 centimeters above the maximal melting bath level 2. A ring 3 of wall elements constructed as water-cooled boxes 4, is set upon the upper cylindrical section of the furnace crucible 1. The boxes 4 of the furnace are shown in a condition several melts after the relining of the furnace wall 1. On the front wall 5 facing the furnace interior, not only a layer 11 of refractory mortar applied prior to the first melt is present, but also the slag layer 12, formed during the melting process on the box front wall 5. Due to the intensive bonding between these two layers 11, 12 and on account of the chemical reaction proceeding between these two masses, fusion with, and infiltration into each other, of these masses will occur, so that there is no more separation between these masses.

The furnace has a circular section wherein wall elements, in the shape of a segment of an annulus, are constructed as water-cooled boxes 4. The plate wall 5 of every box 4 facing the furnace interior is shaped at the end of its fabrication by bending according to the curvature of the lateral furnace wall. This curvature of the steel wall 5 can be seen in detail from FIGS. 7, 9, and 12, showing the steel wall 5 in bent state.

In the steel wall 5 of every box 4 facing the furnace interior, a multitude of recesses worked into the solid material of the box 4 is provided, extending across the width and height of the steel wall 5. In the case of the first and second design versions, these recesses are provided as longitudinal recesses in the shape of grooves 6; in the third version, however, as cylindrical recesses in the shape of bores 7. Herein the recesses show, essentially uniformly, essentially rectangular zones of transition to the sections 8 of the plate wall 5, which laterally abut the grooves 6 or the bores 7.

The longitudinal recesses, i.e. grooves 6, provided in the first and second version, will, in the first version, run in the direction of the circumference of the furnace, i.e. at a right angle to the direction of the circumference of the furnace, and at a right angle to the direction of the furnace axis X, but in the second version the grooves run vertical to the circumference of the furnace, i.e. in the direction of the furnace axis X. Herein, the longitudinal recesses i.e. grooves 6, subdivide the plate wall 5 at its side facing the furnace interior into equal strip-like sections, with provision in each case for several grooves at identical distance b, each with a width a and a depth c extending across, respectively, the entire width and height of the plate wall. In the case of the first and second version, the ratio width a: a lateral distance b: depth c of the grooves 6 is set at about 1:2:1, by dimensioning the width a and the depth c of these grooves 6 with about 16 millimeters and the lateral distance b with about 30 millimeters.

The wall thickness d of the platewall facing the furnace interior of the box 4, amounts in the first and second version as well as in the third version, to about 30 millimeters, wherein the depth c of the recesses, i.e. the grooves 6 and of the bores 7, is correspondingly dimensioned at about half the wall thickness.

In the case of the third version however, the recesses are in the form of cylindrical bores 7, as can be seen especially from FIG. 10. As this Figure also shows, the cylindrical bores 7 of the said version are evently distributed with the uniform smallest lateral distance b checkerboardlike across the width and height of the platewall 5. FIG. 10 shows a pattern of bores where each bore of the central zone has about the same distance to the 6 bores surrounding it.

Fabrication of the plate wall 5 facing the furnace interior of every box 4 proceeded from a flat steel plate; onto the flat steel plate, application is made of, respectively, the groove 6 or the bore 7 before the plates will be formed by bending according to the curvature of the furnace wall wherein they obtain the curvature seen from FIGS. 7, 9, and 12. The longitudinal recesses; i.e. grooves 6, are machined by milling; the cylindrical recesses, however i.e. the bores 7, by drilling.

As shown in FIGS. 7, 9, and 12, the grooves 6 or bores 7 provided so far have obtained a swallowtail section during bending so that these recesses are tapering toward the furnace interior. They are indicated there with 6' and 7'. The plate wall 5 of every box 4 facing the furnace interior is, in the bent state of the box 4, and prior to the first melt, lined outside with a layer 11 of refractory mortar. In operating the furnace, a further fireproof layer in the form of a slag layer 12 will form upon the first applied layer 11 of refractory mortar. This slag layer originates from the slag spattered by the arc of the furnace onto the box front wall 5.

The recesses, i.e. grooves 6 and bores 7, serve in the case of the first and second version as also in the third version, as adhesive devices for the better adhesion of these two fireproof layers, i.e. of the initially applied layer 11 of refractory material as well as of the slag layer 12 forming during operation. Herein, the recesses with a transformed section, i.e. the grooves 6 as well as the bores 7, form a particularly suitable shape of the adhesive device.

We claim:

1. A box-shaped shallow, water-cooled wall element of steel plate for the construction of a wall portion of a melting furnace, especially an arc furnace, above the bath of the melt in the furnace, comprising, a front wall adapted to face the interior of the furnace and being curved according to the curvature of the latter, a rear wall spaced from and substantially parallel to said front wall, a pair of short side walls connecting lateral edges of said front and rear wall to each other, a top and a bottom wall respectively connecting the top and bottom edges of said front and rear wall to each other, a cooling water inlet, a cooling water outlet, and at least one guide vane in the interior of the wall element for guiding the cooling water between inlet and outlet, said front wall being provided over the whole outer surface thereof adapted to face the interior of the furnace with recesses to facilitate adhesion of a layer of refractory material to be applied thereto and adhesion of slag splattered thereagainst during operation of said furnace, wherein the area of said recesses at said outer surface is smaller than the area of the remaining steel plate at said surface to thus enhance heat conduction from the interior of the furnace to the cooling water passing through the wall element and to prevent damage of said front wall when the protective layer of refractory material is missing completely or in part.

2. A water-cooled wall element as defined in claim 1, wherein said recesses are constituted by substantially parallel grooves.

3. A water-cooled wall element as defined in claim 2, wherein said grooves are of equal cross-section and equally spaced from each other.

4. A water-cooled wall element as defined in claim 2, wherein said grooves extend in horizontal direction.

5. A water-cooled wall element as defined in claim 2, wherein said grooves extend in vertical direction.

6. A water-cooled wall element as defined in claim 1, wherein said recesses are constituted by bores having parallel axes.

7. A water-cooled wall element as defined in claim 6, wherein said bores are arranged in a plurality of parallel rows with the bores in adjacent rows offset with respect to each other.

8. A water-cooled wall element as defined in claim 7, wherein said rows are equally spaced from each other and the bores in each row have the same diameter and are also equally spaced from each other.

9. A water-cooled wall element as defined in claim 1, wherein said recesses have a depth which is about half of the thickness of the front wall.

10. A water-cooled wall element as defined in claim 3, wherein the ratio between the width of each groove and the distance between adjacent grooves is about 1:2.

11. A water-cooled wall element as defined in claim 3, wherein the ratio between the width of each groove to the distance between adjacent grooves to the depth of each groove is about 1:2:1.

12. A water-cooled wall element as defined in claim 8, wherein the ratio between the diameter of each bore to the distance of the bores in each row is about 1:2.

13. A water-cooled wall element as defined in claim 1, wherein said recesses have a dove-tailed cross-section tapering toward the outer surface to enhance anchoring of a layer of refractory material to said outer surface.

* * * * *